US007607454B2

(12) United States Patent
Miyazoe et al.

(10) Patent No.: US 7,607,454 B2
(45) Date of Patent: Oct. 27, 2009

(54) VACUUM AND VACUUM-BREAKING COMPOSITE VALVE

(75) Inventors: Shinji Miyazoe, Tsukubamirai (JP); Takumi Matsumoto, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 568 days.

(21) Appl. No.: 11/401,929

(22) Filed: Apr. 12, 2006

(65) Prior Publication Data

US 2006/0237068 A1 Oct. 26, 2006

(30) Foreign Application Priority Data

Apr. 26, 2005 (JP) ..... 2005-128170

(51) Int. Cl.
*F15B 20/00* (2006.01)

(52) U.S. Cl. ..... 137/596.16; 137/596.18; 137/625.64

(58) Field of Classification Search ..... 137/596.16, 137/596.18, 602, 605, 606, 625, 625.2, 625.6, 137/625.64
See application file for complete search history.

(56) References Cited

U.S. PATENT DOCUMENTS 2,051,894 A * 8/1936 Price et al. ..... 137/606
2,548,933 A * 4/1951 Barnett ..... 137/606
2,583,185 A * 1/1952 McLeod ..... 137/596.16
2,908,291 A * 10/1959 Hunt ..... 137/625.64
2,973,746 A * 3/1961 Jupa ..... 137/625.6
3,042,058 A * 7/1962 Rene ..... 137/625.64
3,084,676 A * 4/1963 Herion et al. ..... 137/596.16
3,598,148 A * 8/1971 Kroffke ..... 137/596.16
3,603,348 A * 9/1971 Wright ..... 137/625.64
3,757,818 A * 9/1973 Sweet ..... 137/596.16
3,870,073 A * 3/1975 Ruchser et al. ..... 137/596.16
3,874,405 A * 4/1975 Thayer ..... 137/596.16
3,918,488 A * 11/1975 Minami ..... 137/596.16
4,083,381 A * 4/1978 McClocklin et al. ... 137/596.16
4,269,225 A * 5/1981 Ruchser et al. ..... 137/596.16
4,291,613 A * 9/1981 Porter ..... 137/596.16
5,415,437 A * 5/1995 Asou et al. ..... 285/124.4
5,597,015 A * 1/1997 Asou et al. ..... 137/625.64
5,704,399 A * 1/1998 Hayashi et al. ..... 137/884
5,725,255 A * 3/1998 Hayashi et al. ..... 137/625.64
5,924,439 A * 7/1999 Miyazoe et al. ..... 137/596.16
5,996,610 A * 12/1999 Sato et al. ..... 137/271
6,026,856 A * 2/2000 Miyazoe et al. ..... 137/596.16
6,913,037 B2 * 7/2005 Miyazoe et al. ..... 137/625.64

(Continued)

FOREIGN PATENT DOCUMENTS

JP 5-26367 2/1993

(Continued)

*Primary Examiner*—Stephen Hepperle
*Assistant Examiner*—Craig Price
(74) *Attorney, Agent, or Firm*—Oblon, Spivak, McClelland, Maier & Neustadt, L.L.P.

(57) ABSTRACT

A composite valve includes a main valve unit that individually opens and closes a vacuum channel for applying vacuum pressure to a load and a pressure channel for supplying vacuum-breaking pressure fluid with two valves for vacuuming and pressurizing; a channel combining section that connects the vacuum channel and the pressure channel to the load via a combining port; and a pilot valve unit that opens and closes the valve members individually with two pilot valves. The main valve unit, the channel combining section, and the pilot valve unit have the same width, and connect to one another in line along the axis of the valve.

10 Claims, 5 Drawing Sheets

U.S. PATENT DOCUMENTS

| | | | | |
|---|---|---|---|---|
| 7,118,087 | B2 * | 10/2006 | Miyazoe et al. | 137/625.64 |
| 7,252,116 | B2 * | 8/2007 | Miyazoe et al. | 137/625.64 |
| 7,438,088 | B2 * | 10/2008 | Matsumoto et al. | 137/625.64 |
| 2002/0007855 | A1 * | 1/2002 | Bento et al. | 137/596.16 |
| 2005/0236053 | A1 * | 10/2005 | Miyazoe et al. | 137/625.64 |
| 2005/0236054 | A1 * | 10/2005 | Miyazoe et al. | 137/625.64 |
| 2006/0237068 | A1 * | 10/2006 | Miyazoe et al. | 137/596.16 |

FOREIGN PATENT DOCUMENTS

| | | |
|---|---|---|
| JP | 8-309684 | 11/1996 |

* cited by examiner

VACUUM AND VACUUM-BREAKING COMPOSITE VALVE

TECHNICAL FIELD

The present invention relates to vacuum and vacuum-breaking composite valves, and in particular, it relates to a composite valve constructed to supply vacuum pressure and vacuum-breaking pressure fluid alternately to a load such as a vacuum pad.

BACKGROUND ART

For example, when works are conveyed to specified places for processing or storage in various processors, vacuum systems are generally used. The vacuum systems include a vacuum pad, a vacuum feeder such as a suction pump, a pressure-fluid feeder that supplies pressure fluid for vacuum breaking, and a vacuum switching unit connected between the vacuum feeder and the pressure-fluid feeder and the vacuum pad. The vacuum systems vacuum works by connecting the vacuum pad to the vacuum feeder through the vacuum switching unit, and after conveying the works to specified positions, the vacuum systems break the vacuum by connecting the vacuum pad to the pressure-fluid feeder through the vacuum switching unit to cancel the suction, thereby releasing the works at the positions.

The vacuum switching units for use in this vacuum systems are a combination of multiple solenoid values or changeover valves, as described in Japanese Unexamined Patent Application Publication No. 5-26367 and No. 8-309684. The solenoid valves or changeover valves are combined with a unit body together with other associated components including a throttle.

However, in the know vacuum switching units, multiple solenoid valves or changeover valves are combined with a unit body together with other associated components in such a manner that the components are disposed at various positions and in various orientations on the unit body. Accordingly, the entire structure of the vacuum switching units is increased in size and complicated, and the channels are also complicated and increased in length, thus having many problems to be solved.

DISCLOSURE OF INVENTION

Accordingly, an object of the invention is to provide a compact and simple vacuum and vacuum-breaking composite valve with a simple and reasonable design structure in which the problems of the arrangement and the length of vacuum and pressure channels are solved.

In order to achieve the object, according an aspect of the invention, there is provided a composite valve having a main valve unit including a vacuum port connected to a vacuum feeder, s pressure port connected to a pressure fluid feeder, a vacuum-side valve member that opens and closes a vacuum channel connecting the vacuum port with a combining port, and a pressure-side valve member that opens and closes a pressure channel connecting the pressure port with the combining port; a channel combining section including the combining port for connecting with a load, filter chambers interposed in the vacuum channel and the pressure channel, respectively, and a filter detachably disposed in each of the filter chambers; and a pilot valve unit including two pilot valves that individually operate the vacuum-side valve member and the pressure-side valve member of the main valve unit. The main valve unit, the channel combining section, and the pilot valve unit have the same width. The channel combining section connects to one end of the main valve unit in the direction of the axis of the main valve unit, and the pilot valve unit connects to the other end, so that the main valve unit, the channel combining section, and the pilot valve unit connect to one another in line along the axis.

Preferably, the main valve unit has a valve hole extending along the axis, the vacuum-side valve member and the pressure-side valve member accommodated in the valve hole so as to be able to individually operate, the valve members having returning pressure-receiving portions with a small receiving area at the facing end surfaces, respectively, and having driving pressure-receiving portions with a large receiving area at the opposite end surfaces, respectively. The returning pressure-receiving portions are always acted upon by pressure fluid from the pressure port, and wherein the driving pressure-receiving portions are always acted upon by pilot fluid supplied from the pilot valves.

Preferably, the combining port is provided at a front end face of the channel combining section; the two filter chambers are provided along the axis in opposite positions of the combining port in the channel combining section; and the filter is detachably mounted in each of the filter chambers with the detachable filter holder from the front end face.

Preferably, the filter is cylindrical in shape, and the filter holder is columnar in shape; the filter holder has a channel hole that constitutes part of the vacuum channel and the pressure channel; one end of the channel hole communicating with the combining port through a hole in the side surface of the filter holder; and the filter is mounted around the outer periphery of the filter holder so as to cover the hole.

Preferably, a throttle valve is mounted on the upper surface of the main valve unit; and the throttle valve controls the flow rate of the pressure fluid flowing in the pressure channel.

Preferably, the both sides of the composite valve are substantially flat connecting surfaces for connecting with other composite valves; and the pressure port and the vacuum port pass through the main valve unit in the cross direction to allow connection with the pressure ports and the vacuum ports of the other composite valves.

According to an embodiment of the invention, a composite valve having the same structure as that of general solenoid valves can be provided owing to a simple and reasonable design structure in which a main valve unit, a channel combining section, and a pilot valve are combined in a line along the axis of the valve. Consequently, a compact and simple structure can be achieved, and the arrangement of vacuum channels and pressure channels can also be simplified, and the length of the channels can be reduced.

BEST MODE FOR CARRYING OUT THE INVENTION

Figure 1:
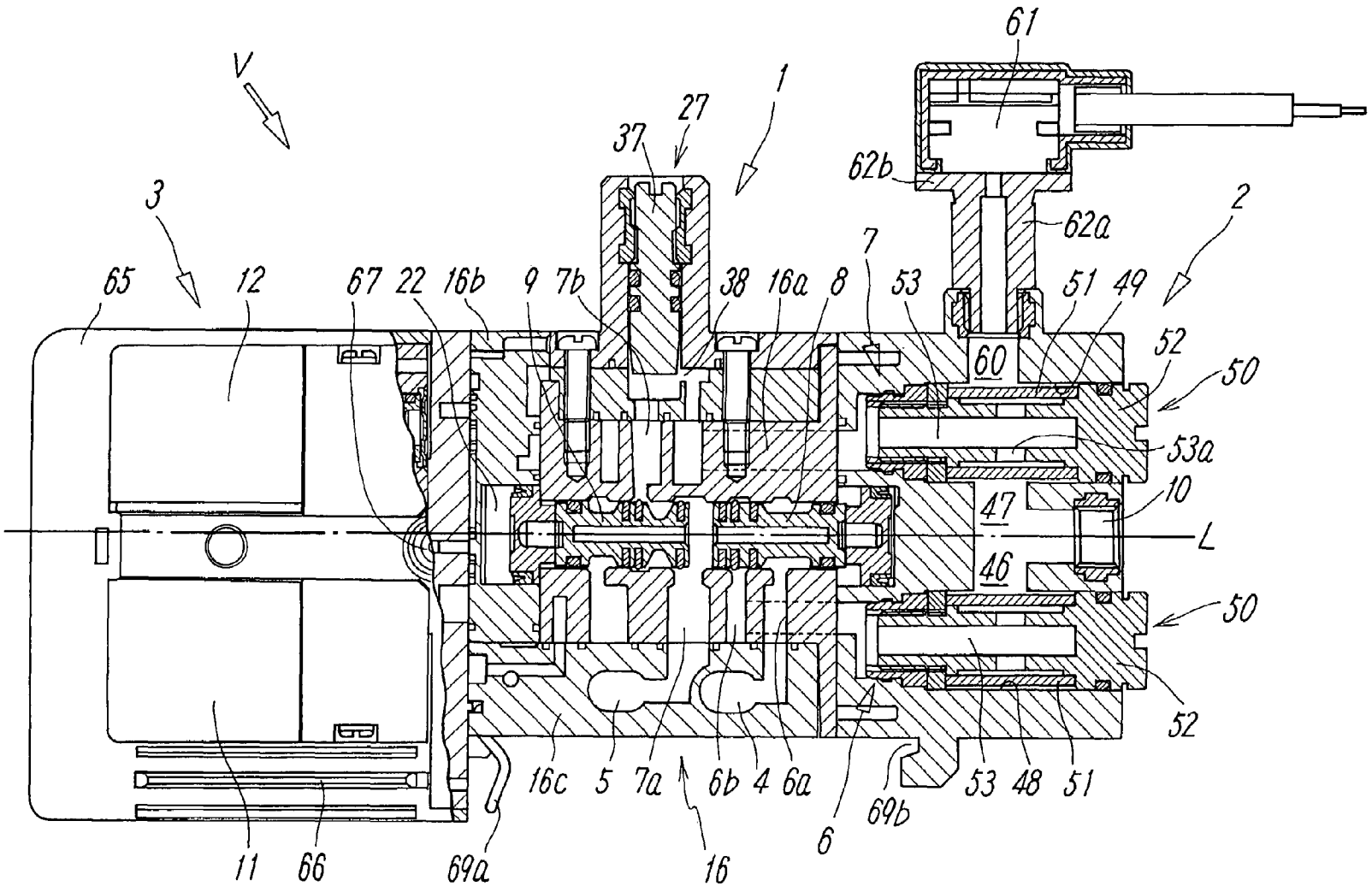
FIG. 1 is a sectional view of a composite valve according to an embodiment of the invention.

FIGS. 1 to 4 show a vacuum and vacuum-breaking composite valve according to an embodiment of the invention. The composite valve V includes a main valve unit 1 that switches a vacuum channel 6 for supplying vacuum pressure to a load and a pressure channel 7 for supplying pressure fluid for vacuum breaking (e.g., air) with a vacuum-side valve member 8 and a pressure-side valve member 9, individually; a channel combining section 2 at which the vacuum channel 6 and the pressure channel 7 are connected to the load through one combining port 10; and a pilot valve unit 3 that switches the two valve members 8 and 9 with two pilot valves 11 and 12, individually. The main valve unit 1, the channel combining section 2, and the pilot valve unit 3 are integrated with one another in line.

Figure 5:
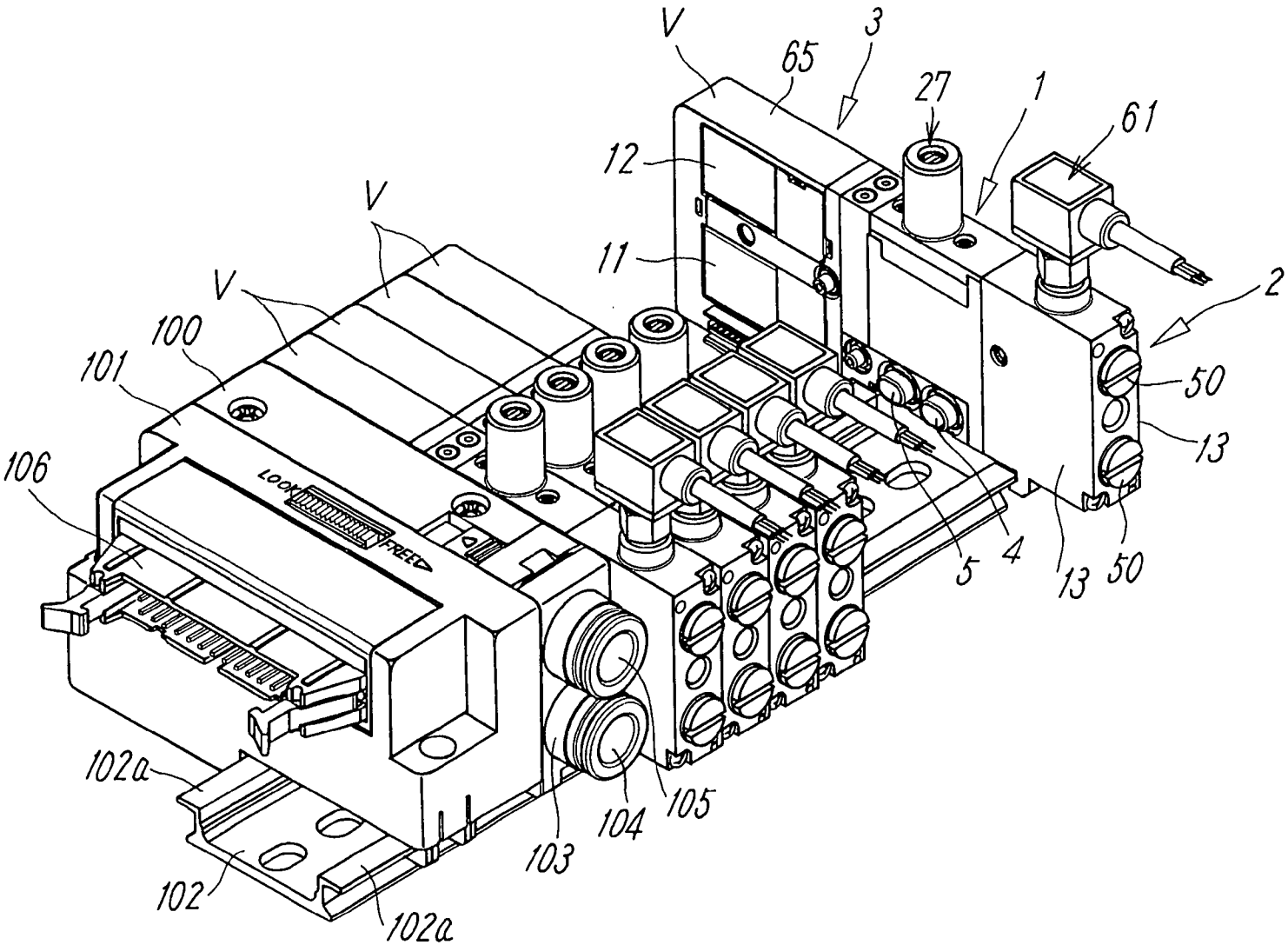
FIG. 5 is a perspective view of a valve assembly halfway through assembling the multiple composite valves according to an embodiment of the invention.

As shown in FIG. 5, the composite valve V connects to other composite valves V with the same structure, and is mounted on a rail 102 together with associated components such as a piping block 100 and a distribution block 101 so as to be used as a valve assembly. Accordingly, the composite valve V has an approximately fixed width (thickness) as a whole, and the both sides in the crosswise direction have a substantially flat surface 13 for connecting with the other composite valves V and associated components.

The concrete structure of the composite valve V will be specifically described hereinbelow.

The main valve unit 1 of the composite valve V has a main-valve-unit housing 16 of a rectangular longitudinal section. The main-valve-unit housing 16 is composed of multiple blocks, that is, a combination of a central valve block 16*a*, a manual block 16*b* at one end of the valve block 16*a* in the direction of the axis L, and a port block 16*c* at the bottom of the valve block 16*a* and the manual block 16*b* and across the valve block 16*a* and the manual block 16*b*.

The valve block 16*a* has a valve hole 17 extending along the axis L. The vacuum-side valve member 8 and the pressure-side valve member 9 of a spool type are accommodated in a half and the other half of the valve hole 17 so as to be operated individually. The valve members 8 and 9 have returning pressure-receiving portions 8*a* and 9*a* with a small receiving area at the facing end surfaces, respectively, and have driving pressure-receiving portions 8*b* and 9*b* with a large receiving area at the opposite end surfaces, respectively. The driving pressure-receiving portions 8*b* and 9*b* are formed of pistons 18 and 19 in contact with the end surfaces of the valve members 8 and 9, respectively. Pilot pressure-receiving chambers 21 and 22 are formed outside the pistons 18 and 19, respectively. When pilot fluid is supplied from the pilot valves 11 and 12 to the corresponding pressure-receiving portions 21 and 22, the valve members 8 and 9 are pushed by the pistons 18 and 19 to move to a communicating position inside the valve hole 17, like the pressure-side valve member 9 of FIGS. 1 and 2. When the pilot fluid in the pressure-receiving chambers 21 and 22 is discharged, the valve members 8 and 9 are pushed by the fluid pressure from a pressure port 5 which acts on the valve members 8 and 9 to return to the breaking position on the outside, like the vacuum-side valve member 8 in FIGS. 1 and 2.

The valve block 16*a* has a first vacuum through hole 6*a* and a second vacuum through hole 6*b* which are open in different positions of the valve hole 17 in the operating region of the vacuum-side valve member 8; and a first pressure through hole 7*a* and a second pressure through hole 7*b* which are open in different positions of the valve hole 17 in the operating region of the pressure-side valve member 9. The first vacuum through hole 6*a* communicates with a vacuum port 4 in the port block 16*c*, while the second vacuum through hole 6*b* communicates with a vacuum communication hole 6*c* open to the surface connected to the channel combining section 2. The first vacuum through hole 6*a*, the valve hole 17, the second vacuum through hole 6*b*, and the vacuum communication hole 6*c* form a main-valve-unit-side vacuum channel portion 6A that is part of the vacuum channel 6. The main-valve-unit-side vacuum channel portion 6A is open or closed in such a way that a valve sealing member 24 of the vacuum-side valve member 8 comes into or out of contact with the land of the inner periphery of the valve hole 17 between the first vacuum through hole 6*a* and the second vacuum through hole 6*b*.

The main-valve-unit-side vacuum channel portion 6A connects to a combining-side vacuum channel portion 6B of a channel combining portion 2, to be described later, to construct the vacuum channel 6.

The first pressure through hole 7*a* communicates with the pressure port 5 of the port block 16*c*, while the second pressure through hole 7*b* passes through the throttle valve 27 and an intermediate through hole 7*d* to communicates with a pressure-communication hole 7*c* open to the surface connected to the channel combining section 2. The first vacuum through hole 7*a*, the valve hole 17, the second vacuum through hole 7*b*, the throttle valve 27, the intermediate through hole 7*d*, and the pressure communication hole 7*c* form a main-valve-unit-side pressure channel portion 7A that is part of the pressure channel 7. The main-valve-unit-side pressure channel portion 7A is open and closed in such a way that a valve sealing member 26 of the pressure-side valve member 9 comes into or out of contact with the land of the inner periphery of the valve hole 17 between the first pressure through hole 7*a* and the second pressure through hole 7*b*.

The main-valve-unit-side pressure channel portion 7A connects to a combining-side pressure channel portion 7B of the channel combining portion 2, to be described later, to construct the pressure channel 7.

The first pressure through hole 7*a* communicating with the pressure port 5 is open to the valve hole 17, between the respective returning pressure-receiving portions 8*a* and 9*a* of the two valve members 8 and 9. The pressure fluid from the pressure port 5 supplied into the valve hole 17 through the first pressure through hole 7*a* always acts on the returning pressure-receiving portions 8*a* and 9*a* of the two valve members 8 and 9.

The vacuum port 4 and the pressure port 5 pass through the port block 16*c* across the width, and have a connecting tube 29 projecting outward from the connecting surface 13 at one end, and have a connecting hole (not shown) having a ring-shaped sealing member at the other end. When the other composite valves V are connected to the connecting surfaces 13 on both sides of the composite valve V, the connecting tube 29 and the connecting hole come into engagement with the connecting holes and the connecting tubes 29 of the other composite valves V to connect the ports airtightly.

The vacuum port 4 and the pressure port 5 connect to the vacuum feeder such as a suction pump and a pressure-fluid feeder that supplies compressed air or the like via the piping block 100 shown in FIG. 5.

The port block 16*c* further includes a pilot discharge port 31 passing therethrough across the width. The pilot discharge port 31 communicates with the two pilot valves 11 and 12 of the pilot valve unit 3 through a pilot communication hole (not shown). On both sides of the pilot discharge port 31, a connecting tube and a connecting hole are provided for connecting with the pilot discharge ports 31 of the other composite valves V.

The manual block 16*b* has two manual operating sections 32 and 33. The manual operating sections 32 and 33 are for achieving the switching of the two pilot valves 11 and 12 by hand. The manual operating sections 32 and 33 have two manual buttons 32*a* and 33*a* disposed along the width on the upper surface thereof. The first manual button 32*a* corresponds to the first pilot valve 11 for operating the vacuum-side valve member 8. The second manual button 33*a* corresponds to the second pilot valve 12 for operating pressure-side valve member 9. When the first manual button 32*a* is depressed, pilot fluid is supplied directly to the vacuum-side pressure receiving chamber 21 to switch the vacuum-side valve member 8 to the communicating position. When the second manual button 33*a* is depressed, pilot fluid is supplied directly to the pressure-side pressure receiving chamber 22 to switch the pressure-side valve member 9 to the communicating position. The structure and operation of the manual operating sections 32 and 33 are well known.

The main-valve-unit housing 16 has a recessed portion on the top, into which a throttle valve body 35 is fixed with screws 36 via a spacer 34. The throttle valve 27 is mounted on the throttle valve body 35. The throttle valve 27 is of a type that controls the opening of a throttle hole 38 by reciprocating a valve rod 37. The valve rod 37 is accommodated in a cylindrical portion 35*a* that rises from the top of the throttle valve body 35 via a sealing member 39 in such a manner that it can rotate and reciprocate therethrough. A male screw 40 at the base end of the valve rod 37 and a female screw 41 adjacent the cylindrical part 35*a* are in engagement with each other. When the valve rod 37 is rotated, the valve rod 37 reciprocates vertically, or in the direction perpendicular to the axis L of the valve, so that a control section 37*a* at the end controls the opening area of the throttle hole 38 interposed in the channel between the second pressure through hole 7*b* and the pressure communication hole 7*c*.

When the spacer 34 is integrated with the valve block 16*a*, the spacer 34 can be omitted.

The channel combining section 2 has a combining-section housing 45 joined with the connecting surface of the main-valve-unit housing 16 of the main valve unit 1. The combining-section housing 45 has approximately the same height and width (thickness) as those of the main-valve-unit housing 16, and has one combining port 10 for connecting to a load substantially at the center of the front end face 45*a* in the direction of the axis L. The combining port 10 is provided at a position substantially coaxial with the valve hole 17 of the main valve unit 1, and connects to the vacuum communication hole 6*c* and the pressure communication hole 7*c* via two branch through holes 46 and 47 and vacuum-side and pressure-side filter chambers 48 and 49, respectively. Thus the branch through hole 46 and the vacuum-side filter chamber 48 form the combining-side vacuum channel portion 6B; and the branch through hole 47 and the pressure-side filter chamber 49 form the combining-side pressure channel portion 7B.

Loads connected to the combining port 10 include a vacuum pad that suck works and conveys them.

The filter chambers 48 and 49 are of the shape of a circular-section long hole. The two filter chambers 48 and 49 are provided at the vertically opposing positions of the combining port 10, from the front end face 45*a* of the combining-section housing 45 in parallel to the axis L and in parallel with each other. The ends of the filter chambers 48 and 49 communicate with the vacuum communication hole 6*c* and the pressure communication hole 7*c* of the main valve unit 1 through connecting holes 48*a* and 49*a*, respectively, and the branch through holes 46 and 47 communicate with the sides at the center of the filter chambers 48 and 49, respectively.

The filter chambers 48 and 49 each have a detachable filter 51. The filter 51 is combined with a filter holder 52 to construct a filter unit 50. The filter unit 50 is detachably mounted in each of the filter chambers 48 and 49. Specifically speaking, the filter holder 52 is columnar in shape, in which a channel hole 53 extending along the length of the filter holder 52 is provided. The channel holes 53 form part of the channel portions 6B and 7B. One end of the channel hole 53 is open to the end of the filter holder 52, and the other end reaches the middle of the length of the filter holder 52, and communicates with a plurality of openings 53*a* open in the side of the filter holder 52.

At the distal end of the filter holder 52, an external thread 52*a* is provided; at the base end, a rotating operation section 52*b* is provided having an engage groove 52*c* for locking a tool such as a driver.

The filter 51 is shaped like a cylinder, and is fitted on the filter holder 52 in such a manner that it covers the opening 53*a* around the outer periphery of the filter holder 52, and fixed thereto in such a manner that the end is supported by a retaining ring 54 screwed to the thread 52*a*.

The filter holder 52 is inserted into each of the filter chambers 48 and 49 from the front end face 45*a* of the combining-section housing 45, and the thread 52*a* at the distal end is screwed into a screw receiver 55 fixed to each of the filter chambers 48 and 49. Thus the filter unit 50 is mounted detachably in the filter chambers 48 and 49. The branch through holes 46 and 47 communicate with the filter chambers 48 and 49, respectively, in the region surrounding the outer periphery of the filters 51 to communicate with the first holes 53*a* of the filter holders 52 via the filters 51. Thus the combining port 10 and the vacuum channel portion 6A and the pressure channel portion 7A of the main valve unit 1 communicate with each other via the filter 51.

In the drawings, reference numeral 56 indicates a sealing member for hermetically sealing the space between the outer peripheries of the filter holders 52 and the inner peripheries of the filter chambers 48 and 49.

A sensor port 60 communicating with the pressure-side filter chamber 49 is provided on the top of the combining-section housing 45. The sensor port 60 is mounted with a pressure sensor 61 for sensing the pressure of pressure fluid with a sensor holder 62. The sensor holder 62 has a cylindrical leg 62*a* screwed into the port 60. The pressure sensor 61 is mounted on a mount portion 62*b* at the upper end of the leg 62*a*. Fluid pressure is introduced to the sensor section of the pressure sensor 61 through a sensor hole 62*c* in the leg 62*a*.

The sensor port 60 communicates with the filter chamber 49 in the region surrounding the outer periphery of the filter 51, in other words, in the region communicating with the hole 53*a* of the filter holder 52 via the filter 51. Thus the fluid pressure filtered by the filter 51 is introduced to the pressure sensor 61.

However, the sensor port 60 and the pressure sensor 61 may be provided to the main-valve-unit housing 16 of the main valve unit 1. Alternatively, the pressure sensor 61 may be a single member separate from the main-valve-unit housing 16 and the combining-section housing 45, and may be connected to the channel.

Although the combining-section housing 45 according to the embodiment is composed of one block, it may be a combination of multiple blocks.

The pilot valve unit 3 includes the two pilot valves 11 and 12 in the upper and lower part in a pilot housing 65, and has an integrated-terminal-type electrical connector 66 for collective wiring at the lower end of the pilot housing 65, and a pilot feed port 67 at the center of the pilot housing 65.

The two pilot valves 11 and 12 communicate with the pilot feed port 67 through multiple pilot channels (not shown) in common, and communicate with the vacuum-side pressure receiving chamber 21 and the pressure-side pressure receiving chamber 22 individually, and also communicate with the pilot discharge port 31. The pilot valves 11 and 12 connect electrically to the electrical connector 66 via an electrically conducting mechanism built in the pilot housing 65. When one of the two pilot valves 11 and 12 is energized, pilot fluid is supplied to the corresponding receiving chambers 21 and 22 to move the valve members 8 and 9 to a communicating position. When the energization is cancelled, the pilot fluid in the receiving chambers 21 and 22 is discharged to return the valve members 8 and 9 to a breaking position.

Since the structure and operation of the pilot valves 11 and 12 are well known, a further detailed description will be omitted.

The pilot feed port 67 has, at both ends, a connecting tube and a connecting hole for connecting the pilot feed port 67 with the pilot feed ports of the other composite valves V, like the pilot discharge port 31.

The electrical connector 66 also has an inserting portion at one side of the connecting surfaces 13 so as to plug in the electrical connector of the other composite valve V, and has a receiving portion on the other side.

In the drawings, reference numerals 69*a* and 69*b* are mounting portions provided from the main-valve-unit housing 16 through the combining-section housing 45, for bringing the composite valve V into engagement with a flange 102*a* of the rail 102 (refer to FIG. 5). The mounting portion 69*a* can be opened or closed elastically relative to the other mounting portion 69*b*.

Figure 2:
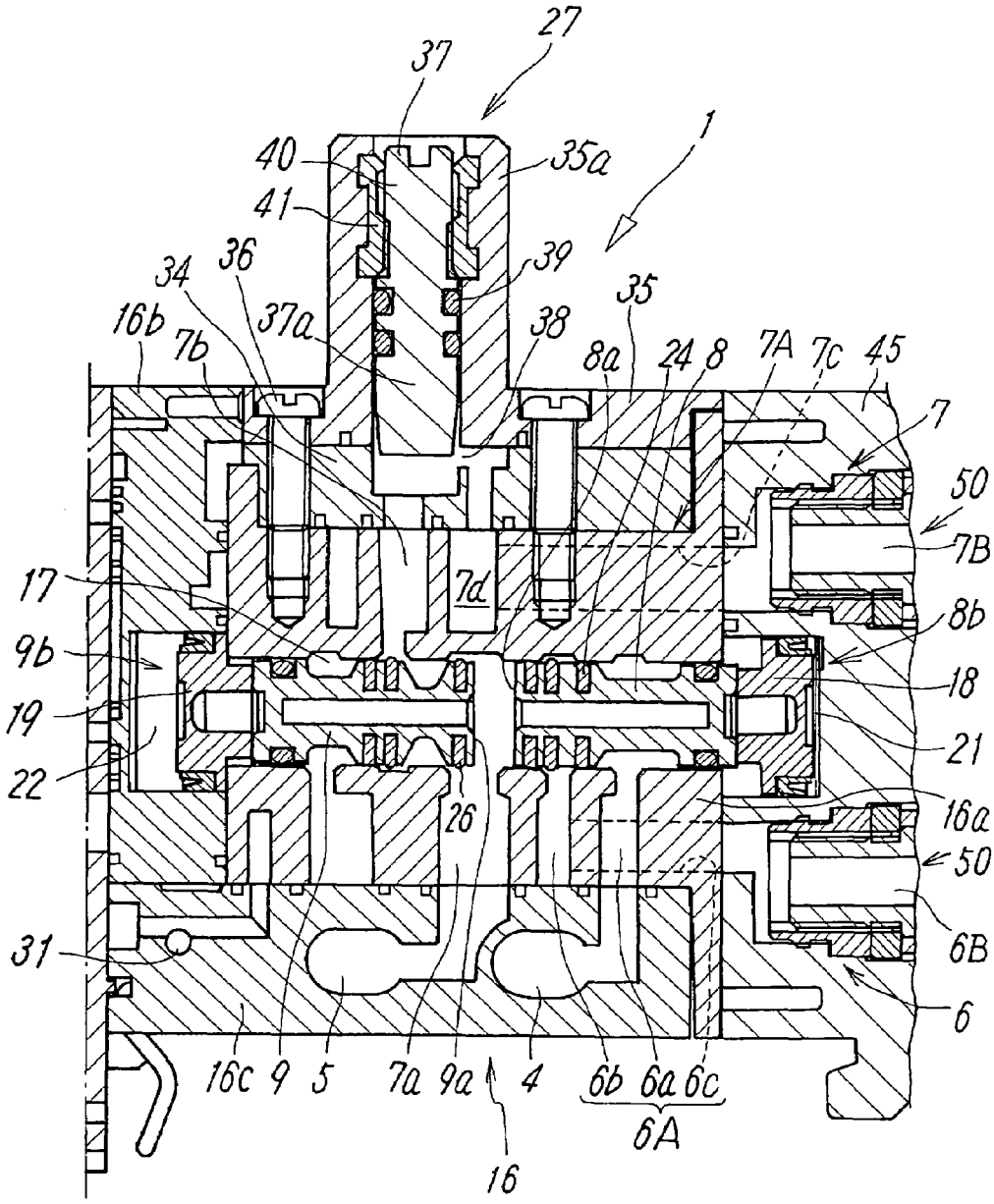
FIG. 2 is an enlarged view of essential part of the main valve unit of FIG. 1.
Figure 3:
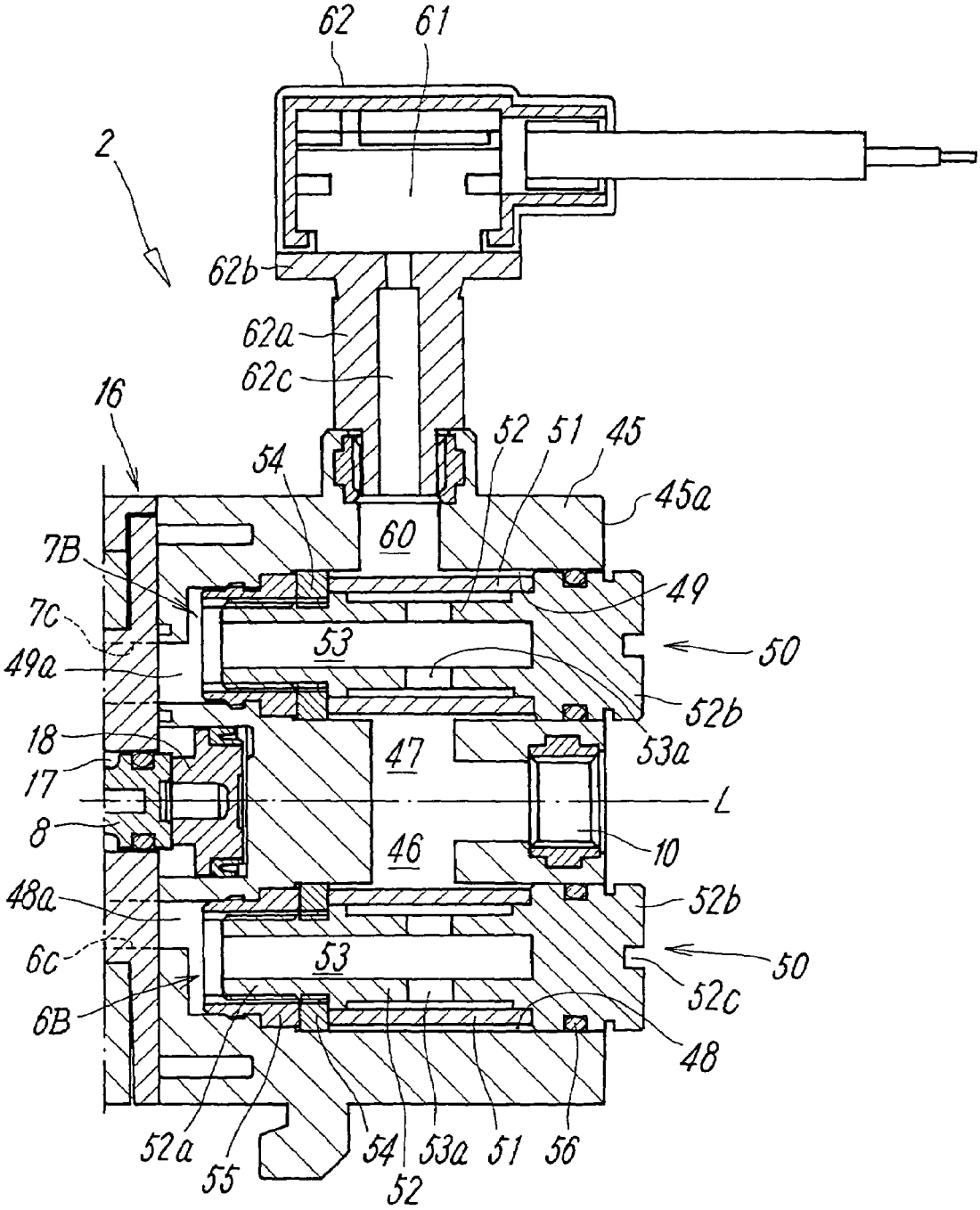
FIG. 3 is an enlarged view of essential part of the channel combining section of FIG. 1.
Figure 4:
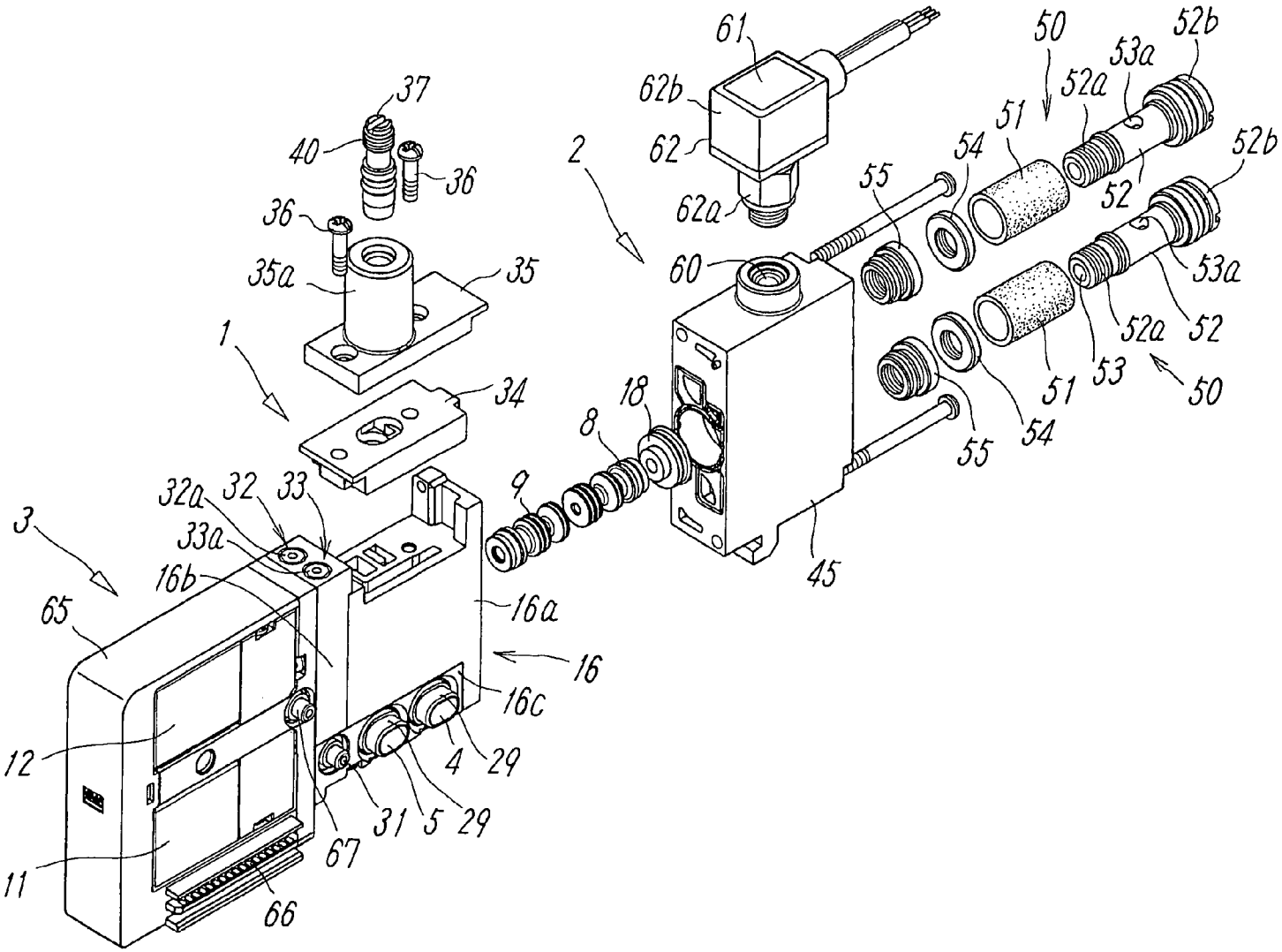
FIG. 4 is an exploded perspective view of the composite valve of FIG. 1.

FIGS. 1 and 2 show the vacuum breaking state of the composite valve V with the above-described structure, in which the second pilot valve 12 of the pilot valve 3 is energized and the first pilot valve 11 is not energized. At that time, pilot fluid is supplied from the second pilot valve 12 to the pressure-side pressure receiving chamber 22, so that the pressure-side valve member 9 is moved forward to the indicated communicating position by the piston 19. Thus the first pressure through hole 7*a* and the second pressure through hole 7*b* communicate with each other through the valve hole 17 to open the pressure channel 7. Accordingly, the pressure fluid from the pressure port 5 passes from the first pressure through hole 7*a* to the second pressure through hole 7*b*, and is throttled by the throttle valve 27, and then passes through the pressure communication hole 7*c* to the pressure channel portion 7B of the channel combining section 2, where it is filtered by the filter 51 in the pressure channel portion 7B, and reaches the combining port 10 and is then supplied to a load.

On the other hand, the vacuum-side valve member 8 is present in the indicated returning position by the pressure fluid acting on the returning pressure-receiving portion 8*a* to block the first vacuum through hole 6*a* and the second vacuum through hole 6*b* from each other, thereby blocking the vacuum channel 6.

Accordingly, when a work is sucked by the vacuum pad connected to the combining port 10, the work is released from suction state.

The pressure of the pressure fluid output from the combining port 10 can be sensed by the pressure sensor 61 mounted to the sensor port 60.

When the first pilot valve 11 is energized and the second pilot valve 12 is not energized from that state, the pilot fluid is supplied from the first pilot valve 11 into the vacuum-side pressure receiving chamber 21, so that the vacuum-side valve member 8 is switched to a communicating position, opposite to that in the drawings, by the pressure of the piston 18 to communicate the first vacuum through hole 6*a* and the second vacuum through hole 6*b* through the valve hole 17, thereby opening the vacuum channel 6. Accordingly, the pressure fluid from the load is sucked from the combining port 10 through the branch through hole 46 and the filter 51 into the channel hole 53 in the filter holder 52, and further passes from the vacuum communication hole 6*c* of the main valve unit 1 through the second vacuum through hole 6*b*, the valve hole 17, and the first vacuum through hole 6*a*, and is sucked into the vacuum port 4.

On the other hand, since the pressure-side pressure receiving chamber 22 comes into discharge state, the pressure-side valve member 9 is returned to a returning position by the pressure fluid acting on the returning pressure-receiving portion 9*a* to block the first pressure through hole 7*a* and the second pressure through hole 7*b* from each other, thereby closing the pressure channel 7.

Thus, the vacuum pad connected to the combining port 10 comes under vacuum pressure to such the work.

When the pressure fluid from the pressure port 5 is supplied through the pressure channel 7 and the combining port 10 to the load to break a vacuum, as described above, foreign matter in the pressure fluid is removed by the filter 51 in the vacuum channel 6, not contaminating works. When the vacuum pressure from the vacuum port 4 is applied through the vacuum channel 6 and the combining port 10 to the load, that is, air is sucked from the combining port 10, foreign matter in the sucked air is removed by the filter 51, not being sucked into the main valve unit 1.

The clogged filter 51 can be individually replaced by removing the whole filter unit 50 from the filter chambers 48 and 49.

Thus the composite valve V can be constructed as a composite valve having the same structure as that of general solenoid valves owing to the simple and reasonable design structure in which the main valve unit 1, the channel combining section 2, and the pilot valve unit 3 are combined in a line along the axis L of the valve V. Consequently, a compact and simple structure can be achieved, and the arrangement of vacuum channels and pressure channels can also be simplified, thus reducing the length of the channels.

Since the both sides of the composite valve in the crosswise direction are substantially flat connecting surfaces 13, the composite valve can be combined with other composite valves into a valve assembly. FIG. 5 shows a manifold valve assembly halfway through assembling in which multiple composite valves V are mounted on the rail 102 together with associated components including the piping block 100 and the distribution block 101. In finished form, the composite valve V separate at the rightmost end in the drawing is joined with the outer side of the four combined composite valves V, and on the outside of which, an end block (not shown) is disposed.

The composite valves V are mounted on the rail 102 in such a manner that the mounting portion at the lower surface is engaged with the flange 102*a* of the rail 102. The piping block 100, the distribution block 101, and the end block are also mounted in the same way. The distribution block 101 and the end block at both ends are fixed to the rail 102 with screws or the like.

The piping block 100 has a vacuum-pipe port 104 and a pressure-pipe port 105 each having a coupling 103, of which the vacuum-pipe port 104 connects to a vacuum feeder such as a suction pump, and the pressure-pipe port 105 connects to a pressure feeder, so that vacuum pressure and pressure fluid are concentrated to the composite valves V through the piping block 100.

The distribution block 101 has a centralized-terminal-type base connector 106 serving as the base for collective wiring. The base connector 106 is connected to the centralized-terminal-type electrical connector 66 of the composite valve V. Thus power is supplied collectively to the composite valves V with the base connector 106 as the base station.

The composite valve V has a structure as a connecting-type composite valve to be connected with other composite valves, in which a vacuum port, a pressure port, a pilot supply port, and a pilot discharge port can be connected to the ports of the other composite valves as common ports. Alternatively, a single composite valve is possible. In this case, the ports are constructed as independent ports.

The invention claimed is:

1. A composite valve, comprising:

a main valve unit including a vacuum port connected to a vacuum feeder, a pressure port connected to a pressure fluid feeder, a vacuum-side valve member that opens and closes a vacuum channel connecting the vacuum port with a combining port, and a pressure-side valve member that opens and closes a pressure channel connecting the pressure port with the combining port;

a channel combining section including the combining port for connecting with a load, filter chambers respectively interposed in the vacuum channel and the pressure channel, and a filter detachably disposed in each of the filter chambers; and a pilot valve unit including two pilot valves that individually operate the vacuum-side valve member and the pressure-side valve member of the main valve unit, wherein the main valve unit, the channel combining section, and the pilot valve unit have a same width, the channel combining section connects to one end side of the main valve unit in a direction of an axis of the main valve unit, and the pilot valve unit connects to an other end side, so that the main valve unit, the channel combining section, and the pilot valve unit connect to one another in a line along the axis, wherein the combining port is provided at a front end face of the channel combining section, the filter chambers are provided along the axis in opposite positions of the combining port in the channel combining section, and the filter is detachably mounted in each of the filter chambers with a detachable filter holder from the front end face via the detachable filter holder, and wherein the filter is cylindrical in shape, the filter holder is columnar in shape, a channel hole that constitutes part of the vacuum channel and the pressure channel is formed in an interior of the filter holder, one end of the channel hole communicating with the combining port through a hole in a side surface of the filter holder, and the filter is mounted around an outer periphery of the filter holder so as to cover the hole.

2. The composite valve according to claim 1, wherein the main valve unit has a valve hole extending along the axis, the vacuum-side valve member and the pressure-side valve member accommodated in the valve hole so as to be individually operated, the valve members having returning pressure-receiving portions with a small receiving area at facing end surfaces, respectively, and having driving pressure-receiving portions with a large receiving area at opposite end surfaces, respectively, and wherein the returning pressure-receiving portions are always acted upon by pressure fluid from the pressure port, and wherein the driving pressure-receiving portions are always acted upon by pilot fluid supplied from the pilot valves.

3. The composite valve according to claim 1, further comprising substantially flat side surfaces for connecting with other composite valves, and wherein the pressure port and the vacuum port pass through the main valve unit in a cross direction to allow connection with other pressure ports and other vacuum ports of the other composite valves.

4. The composite valve according to claim 3, wherein a throttle valve is mounted on an upper surface of the main valve unit, the throttle valve controlling a flow rate of pressure fluid flowing in the pressure channel.

5. The composite valve according to claim 2, further comprising substantially flat side surfaces for connecting with other composite valves, and wherein the pressure port and the vacuum port pass through the main valve unit in a cross direction to allow connection with other pressure ports and other vacuum ports of the other composite valves.

6. The composite valve according to claim 5, wherein a throttle valve is mounted on an upper surface of the main valve unit, the throttle valve controlling a flow rate of pressure fluid flowing in the pressure channel.

7. A composite valve, comprising:

a main valve unit including a vacuum port connected to a vacuum feeder, a pressure port connected to a pressure fluid feeder, a vacuum-side valve member that opens and closes a vacuum channel connecting the vacuum port with a combining port, and a pressure-side valve member that opens and closes a pressure channel connecting the pressure port with the combining port;

a channel combining section including the combining port for connecting with a load, filter chambers respectively interposed in the vacuum channel and the pressure channel, and a filter detachably disposed in each of the filter chambers; and a pilot valve unit including two pilot valves that individually operate the vacuum-side valve member and the pressure-side valve member of the main valve unit, wherein the main valve unit, the channel combining section, and the pilot valve unit have a same width, the channel combining section connects to one end side of the main valve unit in a direction of an axis of the main valve unit, and the pilot valve unit connects to an other end side, so that the main valve unit, the channel combining section, and the pilot valve unit connect to one another in line along the axis, wherein a throttle valve is mounted on an upper surface of the main valve unit, the throttle valve controlling a flow rate of pressure fluid flowing in the pressure channel, and wherein the combining port is provided at a front end face of the channel combining section, the filter chambers are provided along the axis in opposite positions of the combining port in the channel combining section, and the filter is detachably mounted in each of the filter chambers with a detachable filter holder from the front end face via the detachable filter holder.

8. The composite valve according to claim 7, wherein the filter is cylindrical in shape, the filter holder is columnar in shape, a channel hole that constitutes part of the vacuum channel and the pressure channel is formed in an interior of the filter holder, one end of the channel hole communicating with the combining port through a hole in a side surface of the filter holder, and the filter is mounted around an outer periphery of the filter holder so as to cover the hole.

9. The composite valve according to claim 7, wherein the main valve unit has a valve hole extending along the axis, the vacuum-side valve member and the pressure-side valve member accommodated in the valve hole so as to be individually operated, the valve members having returning pressure-receiving portions with a small receiving area at facing end surfaces, respectively, and having driving pressure-receiving portions with a large receiving area at opposite end surfaces, respectively, wherein the returning pressure-receiving portions are always acted upon by pressure fluid from the pressure port, and wherein the driving pressure-receiving portions are always acted upon by pilot fluid supplied from the pilot valves.

10. The composite valve according to claim 9, wherein the filter is cylindrical in shape, the filter holder is columnar in shape, a channel hole that constitutes part of the vacuum channel and the pressure channel is formed in an interior of the filter holder, one end of the channel hole communicating with the combining port through a hole in a side surface of the filter holder, and the filter is mounted around an outer periphery of the filter holder so as to cover the hole.

* * * * *